US005816898A

United States Patent [19]

Wirth, Jr. et al.

[11] Patent Number: 5,816,898

[45] Date of Patent: Oct. 6, 1998

[54] CUTTER SHARPENING DEVICE

[75] Inventors: John Wirth, Jr.; Jay L. Sanger; Mark K. McCool, all of Casper, Wyo.

[73] Assignee: Woodworker's Supply, Casper, Wyo.

[21] Appl. No.: 834,176

[22] Filed: Apr. 15, 1997

Related U.S. Application Data

[63] Continuation of Ser. No. 588,354, Jan. 18, 1996, abandoned.

[51] Int. Cl.[6] ..... B24B 41/06

[52] U.S. Cl. ..... 451/48; 451/404; 451/371

[58] Field of Search ..... 451/403, 404, 451/371, 377, 367, 48, 386, 378, 391, 390, 405, 370, 374, 375

[56] References Cited

U.S. PATENT DOCUMENTS

| | | | |
|---|---|---|---|
| 460,496 | 9/1891 | Bancroft . | |
| 1,155,987 | 10/1915 | Beckett | 451/405 |
| 1,335,247 | 3/1920 | Lask . | |
| 1,395,664 | 11/1921 | Benson . | |
| 1,414,970 | 5/1922 | Nelson | 451/405 |
| 2,607,105 | 8/1952 | Barkus | 451/404 |
| 2,672,714 | 3/1954 | Wilson | 451/404 |
| 2,701,432 | 2/1955 | Kent | 451/404 |
| 3,135,073 | 6/1964 | Odle | 451/389 |
| 3,200,540 | 8/1965 | Lavallee . | |
| 3,298,141 | 1/1967 | Daubitz | 451/404 |
| 3,559,349 | 2/1971 | Imahashi | 451/389 |
| 3,818,641 | 6/1974 | Long | 451/389 |
| 3,820,286 | 6/1974 | Burch . | |
| 3,872,626 | 3/1975 | White . | |
| 3,940,888 | 3/1976 | Wain | 451/389 |
| 4,263,753 | 4/1981 | Imahashi | 451/389 |
| 4,461,121 | 7/1984 | Motzer et al. . | |
| 4,561,815 | 12/1985 | Trevarrow . | |
| 4,641,821 | 2/1987 | Jaworski . | |
| 4,667,446 | 5/1987 | Imahashi | 451/389 |
| 5,352,075 | 10/1994 | Stephens . | |
| 5,435,774 | 7/1995 | Imahashi | 451/389 |

*Primary Examiner*—Robert A. Rose

*Attorney, Agent, or Firm*—Cushman Darby & Cushman Intellectual Property Group of Pillsbury Madison & Sutro, LLP

[57] ABSTRACT

A cutter sharpening accessory or cutter holder for use in conjunction with a drill press, radial arm saw or like woodworking apparatus to which a grinding tool, such as a diamond cup wheel, can be secured and rotated at high speed and having a work surface disposed thereunder on which the holder of the invention can be displaced relative to the grinding tool. The cutter sharpening accessory provided in accordance with the invention is adapted to rough and micro adjustment both radially and radial transversely to properly position a cutter to be sharpened relative to the horizontally disposed grinding face of the grinding tool. Continuous adjustment vertically is advantageous provided, furthermore, to ensure that the surface to be ground is properly located vertically relative to the grinding tool. In use, once the cutting face to be ground is positioned properly, the grinding cup wheel drive mechanism, for example the drill press, is turned on and the cutter holder is slid back and forth several times under the grinding wheel to grind the face of the cutter. To facilitate the precise, linear displacement of the cutter holder, a stop may be suitably positioned on the work surface and anchored with respect thereto and used as an abutting guide surface for the cutter holder.

10 Claims, 6 Drawing Sheets

CUTTER SHARPENING DEVICE

This is a continuation of application Ser. No. 08/588,354, filed on Jan. 18, 1996, which was abandoned upon the filing hereof.

BACKGROUND OF THE INVENTION

1. Field of the Invention

The present invention relates to a cutter holder for use in conjunction with a grinding device, in particular for sharpening rotatable cutting tools such as router bits and shapers.

2. Description of Related Art

Router bits and shapers present difficulties in grinding or regrinding cutting edges. While numerous grinding machines have been developed to date, typically such devices require the user to advance the part to be sharpened towards a grinding wheel to grind and thus sharpen a face or blade of the cutter. For an inexperienced user, abutting the cutter against the grinding wheel may disadvantageously lead to excessively grinding the part and may not achieve the desired sharpening. Moreover, many conventional sharpening devices simply cannot provide the necessary degree of accuracy required for sharpening router bits, shapers and like cutting instruments. Finally, many conventional cutter sharpeners are highly specialized machines adapted solely to the sharpening purpose. For the small shop or hobbyist, this undesirably necessitates a significant expenditure of money and requires significant dedicated space to accommodate the entire apparatus.

SUMMARY OF THE INVENTION

It is an object of the present invention to provide a cutter holder for use in combination with a grinding wheel that has been mounted to an otherwise conventional radial arm saw, drill press or the like so that the small shop/hobbyist can use existing equipment for actuating the grinding wheel and can mount the tool to be sharpened to the holder for movement on an existing work surface relative to the mounted grinding wheel.

It is yet another object of the invention to provide a cutter holder which enables precise linear motion in a precise orientation relative to a grinding wheel, such as a diamond cup wheel, to grind and thus sharpen the cutting surfaces of the shaper cutter or router bit.

It is a further object of the invention to provide a cutter holder that is adjustable rotationally, radial transversely and vertically to properly orient the cutting blade surface to be ground relative to the grinding wheel, that is in turn mounted to a drill press, radial arm saw or the like.

Other objects, features, and characteristics of the present invention as well as the methods of operation and functions of the related elements of structure, and the combination of parts and economies of manufacture, will become more apparent upon consideration of the following description and the appended claims with reference to the accompanying drawings, all of which form a part of this specification, wherein like reference numerals designate corresponding parts in the various figures.

DETAILED DESCRIPTION OF THE PRESENTLY PREFERRED EXEMPLARY EMBODIMENTS

Figure 1A:
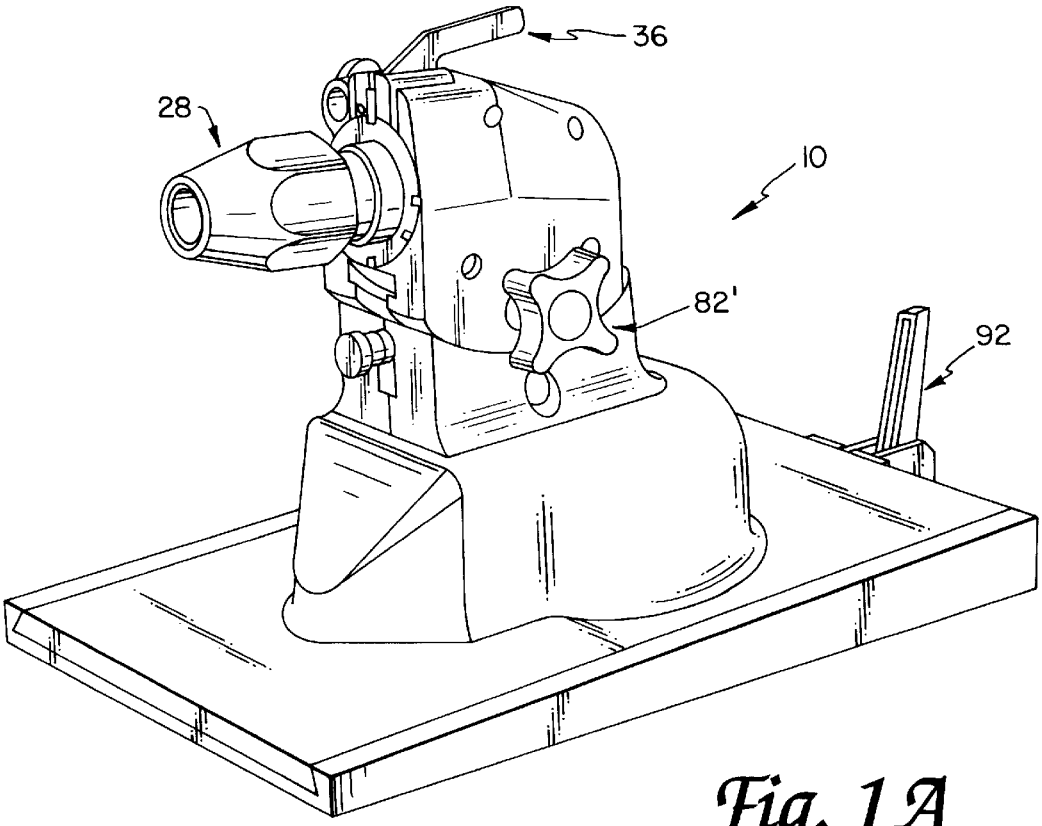
FIG. 1A is a schematic front right perspective view from above of a cutter sharpening device provided in accordance with the present invention.
Figure 1B:
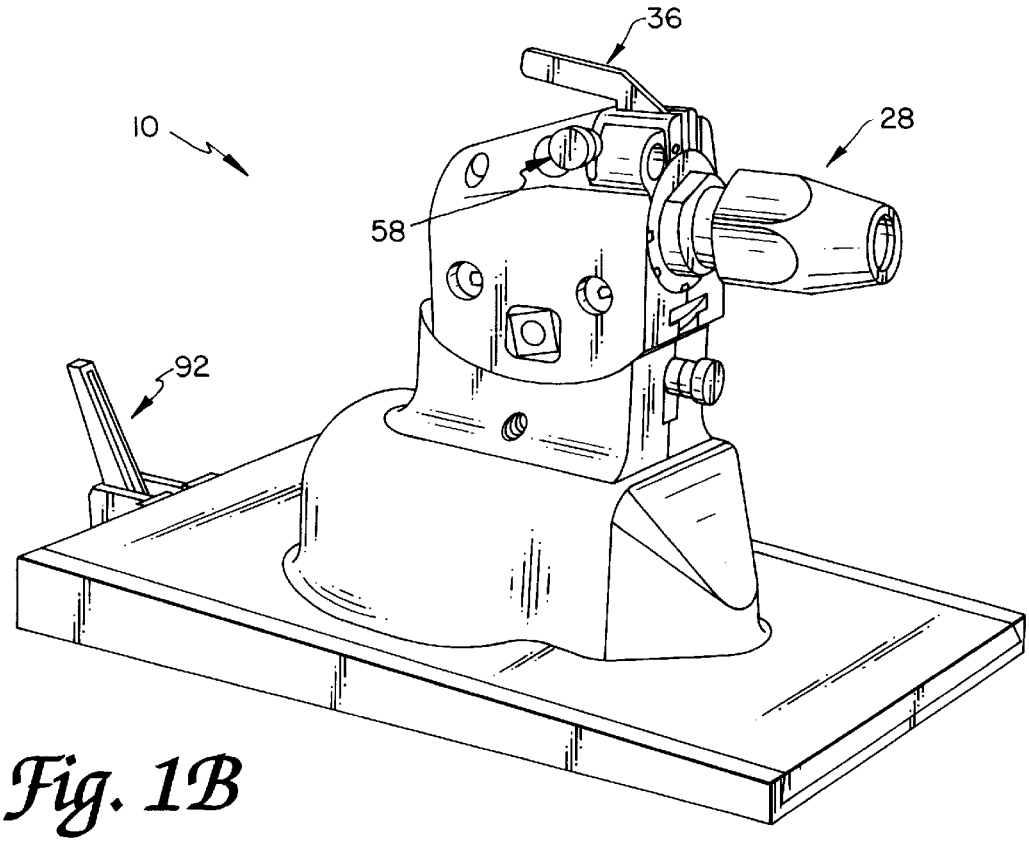
FIG. 1B is a schematic front left perspective view from above of a cutter sharpening device provided in accordance with the present invention.

By way of example and as explained in greater detail below, the present invention relates to a cutter sharpening accessory 10 for use in conjunction with a drill press, radial arm saw or like woodworking apparatus 12 to which a grinding tool 14, such as a diamond cup wheel, can be secured and rotated at high speed and having a work surface disposed thereunder on which the accessory of the invention can be displaced relative to the grinding tool.

The cutter sharpening accessory 10 provided in accordance with the invention is adapted to rough and micro adjustment both radially and radial transversely to properly position a cutter (not shown) to be sharpened relative to the horizontally disposed grinding face of the grinding tool 14. Continuous adjustment vertically is advantageous provided, furthermore, to ensure that the surface to be ground is properly located vertically relative to the grinding tool. To facilitate the precise, linear displacement of the cutter sharpening accessory, a stop may be suitably positioned on the work surface and anchored with respect thereto and used as an abutting guide surface for the cutter sharpening accessory.

The cutter sharpening accessory 10 provided in accordance with the invention, provides for minute radial adjustments of the cutter to properly position a cutting face relative to the grinding tool, as noted above, as well as indexing of the cutter holding collet 16 relative to a collet supporting head 18. To this end, in accordance with the present invention, the collet 16 is received in a collet sleeve 20 and selectively radially locked with respect thereto as detailed below.

Figure 6:
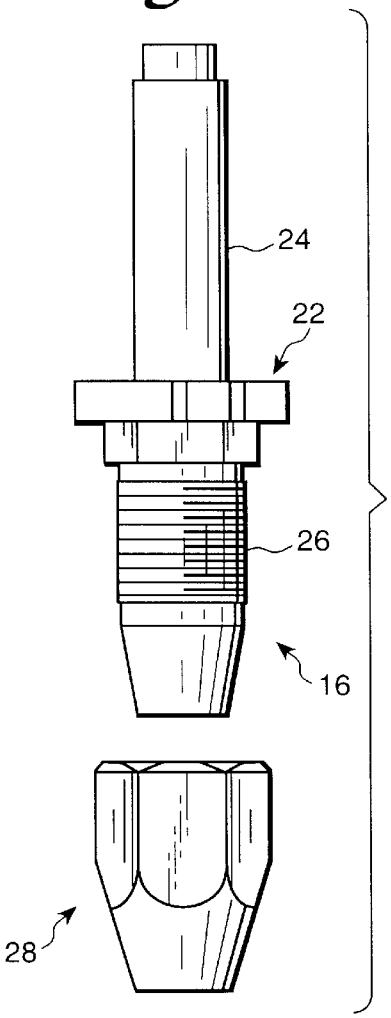
FIG. 6 is an exploded view of a collet assembly provided in accordance with the invention.
Figure 7:
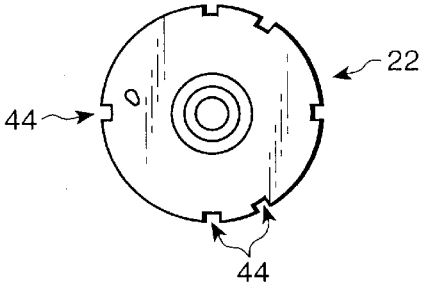
FIG. 7 is an end view of a collet collar provided in accordance with an exemplary embodiment of the invention.
Figure 8:
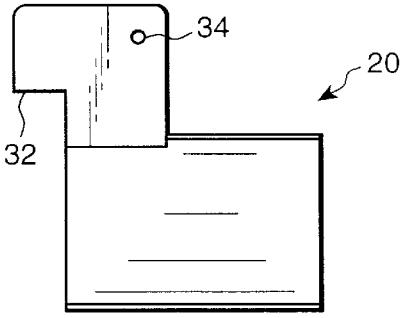
FIG. 8 is an elevational view of a collet sleeve in accordance with invention.
Figure 9:
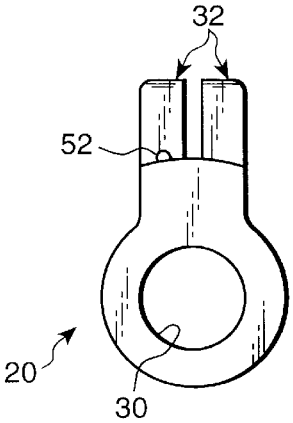
FIG. 9 is a view taken from the left of FIG. 8.
Figure 10:
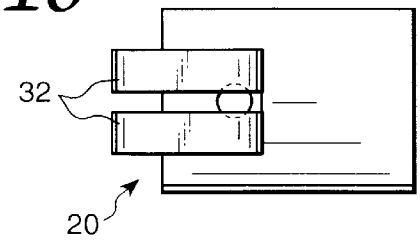
FIG. 10 is a top view taken from above in FIG. 8.
Figure 11:
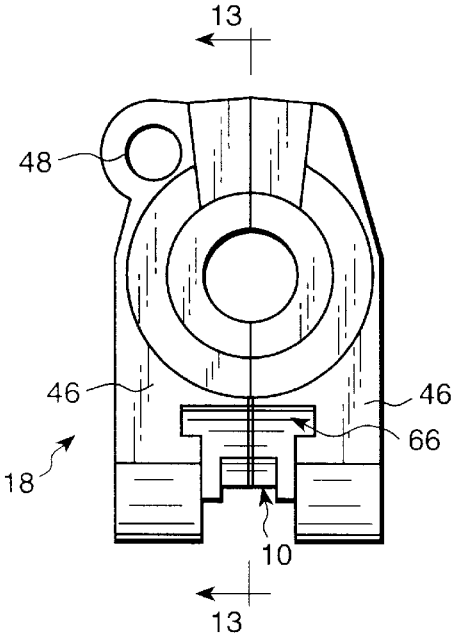
FIG. 11 is a front end view of a collet mounting head provided in accordance with the invention.

As shown in the exploded view of FIG. 6, the collet 16 includes a collet collar 22 mounted to the shaft 24 thereof and a threaded portion 26 for engagement with a collet nut 28 in a known manner to lock a cutter to the collet end.

The collet 16 is placed in an axially extending bore 30 of a collet sleeve 20 which permits minute radial adjustment of the collet 16 and cutter mounted thereto as explained in greater detail below. The collet sleeve 20 includes ears 32 having a gap therebetween and a bore 34 extending therethrough in a direction generally perpendicular to the longitudinal axis of the collet sleeve 30.

Figure 5:
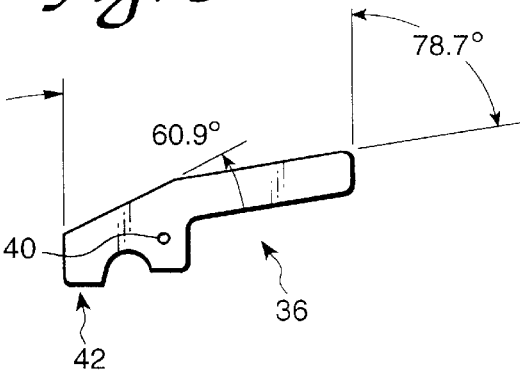
FIG. 5 is an enlarged view of a radial indexing locking lever provided in accordance with the invention.

An indexing locking lever 36 as shown in FIG. 5 is pivotally mounted to the ears 32 of the collet sleeve 20 via a pin 38 inserted through respective bores 34 and a bore 40 defined in the locking lever 36. Conventional means are provided (not shown in detail) for urging the locking lever so that its distal end 42 is urged into nominal engagement with the edge face of the collet collar 22. When the locking lever 36 is aligned with a cut-out 44 of the collar 22, the locking lever locks the collet 16 radially relative to the collet sleeve 20. The collet sleeve 20 is in turn captured between the two halves 46 of the head 18 of the cutter sharpening accessory 10 (described in more detail below) as shown for example in FIG. 2, thus limiting radial displacement of the collet sleeve 20 relative to the head 18. The collet sleeve 20 may be minutely adjusted radially relative to the head 18, however, by means of a radial adjusting cam 48 and related components.

Figure 2:
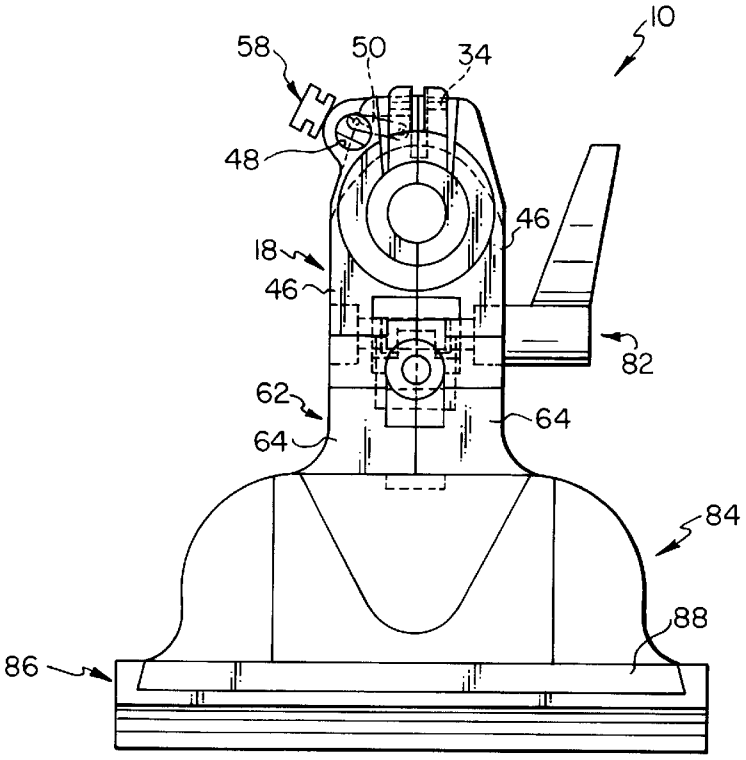
FIG. 2 is a schematic front elevational view of a cutter sharpening device provided in accordance with the invention.
Figure 3:
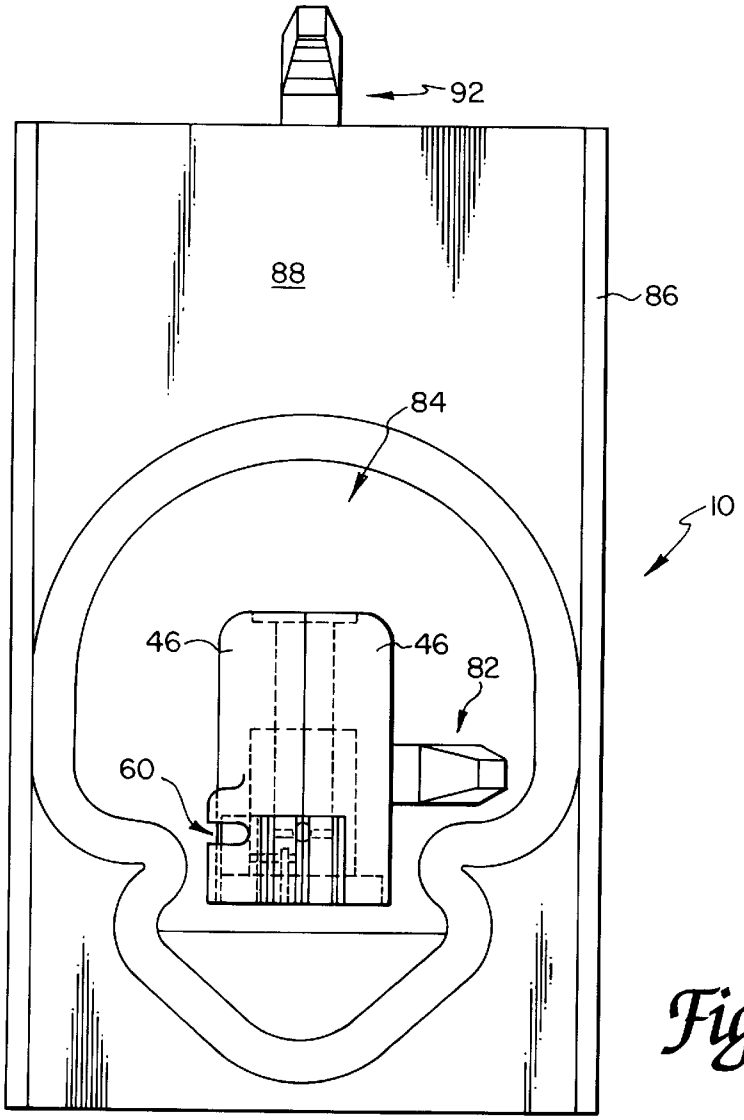
FIG. 3 is a schematic top plan view of the structure of FIG. 2.

More particularly, in accordance with the invention, a connecting rod 50 is pivotally mounted at one end thereof to the collet sleeve 20 as at 52 and pivotally mounted at the other end thereof to a radial adjusting cam 48, as shown in particular in FIG. 2. The connecting rod 50 is suitably pivotally coupled to the radial adjusting cam by a pin or screw inserted through the other end of the connecting rod and into a blind hole 54 of the adjusting cam 48. The radially adjusting cam is, in the illustrated embodiment, generally cylindrical with a bore 56 extending at least partially therethrough for receiving a cam locking screw 58.

Figure 12:
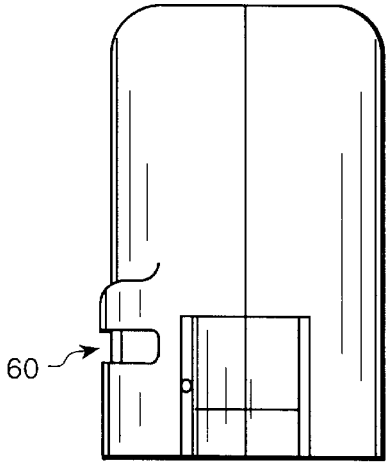
FIG. 12 is a view taken from above in FIG. 11.
Figure 13:
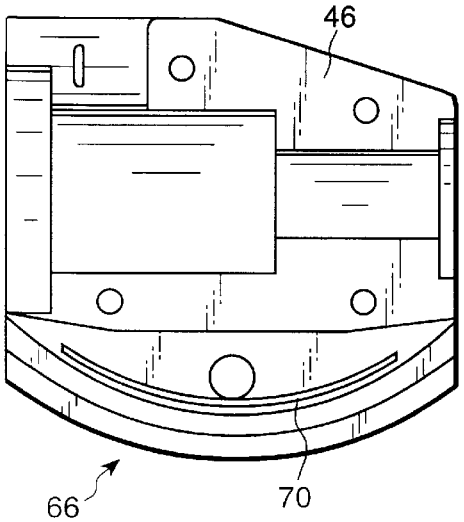
FIG. 13 is an elevational view of one part of the head of FIG. 11, taken a long line 13—13.
Figure 14:
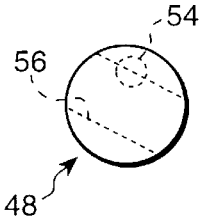
FIG. 14 is a front end view of a radial adjusting cam provided in accordance with the invention.
Figure 15:
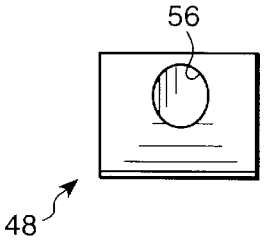
FIG. 15 is a view taken from the left of FIG. 14.
Figure 16:
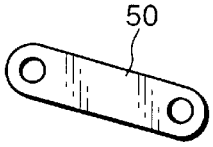
FIG. 16 is a schematic view of a connecting rod for extending between the radial adjusting cam and the collet sleeve provided in accordance with the invention.
Figure 19:
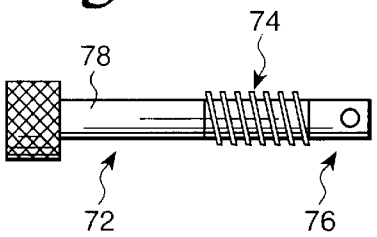
FIG. 19 is an enlarged view of a radial transverse adjusting screw provided in accordance with the invention.
Figure 18:
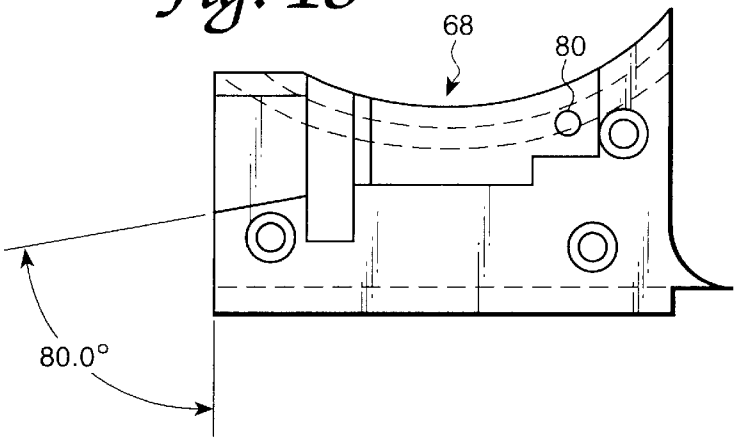
FIG. 18 is a elevational view of one half of the head support taken a long line 18—18 of FIG. 17.
Figure 17:
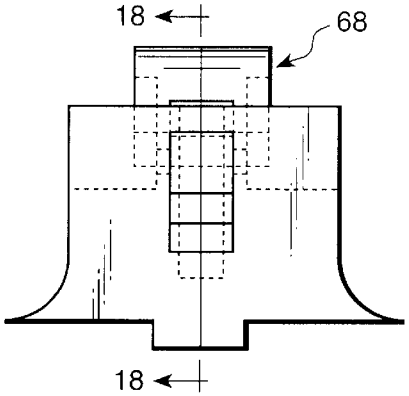
FIG. 17 is a front end view of a head support provided in accordance with the present invention.
Figure 20:
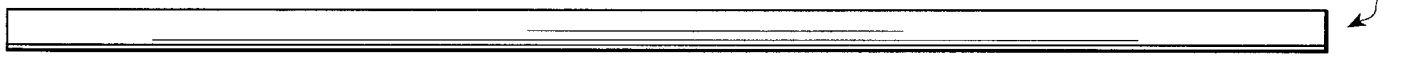
FIG. 20 is a schematic elevational view of a base plate in accordance with the invention.
Figure 21:
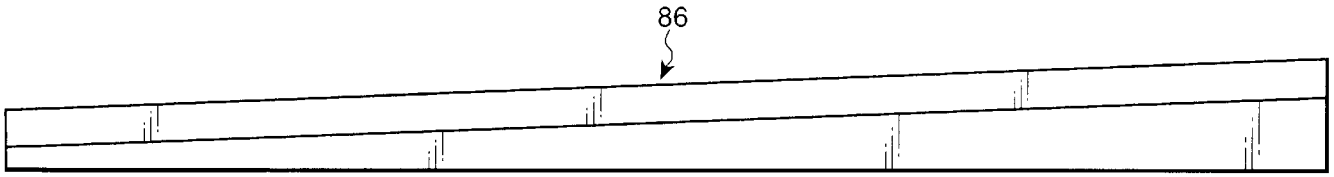
FIG. 21 is a schematic elevational view of a base wedge in accordance with the invention.
Figure 22:
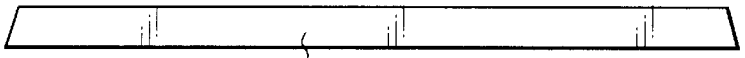
FIG. 22 is an end view of the base plate of FIG. 20.
Figure 23:
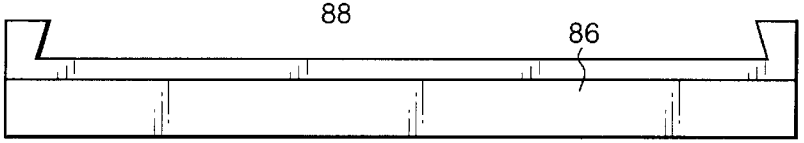
FIG. 23 is an end view of the base wedge of FIG. 21.

As can be seen in particular in FIG. 12, the head 18 of the accessory 10 includes a slot 60 through which the cam locking screw 58 extends into the bore 56 defined therefor in the adjusting cam 48. Thus, when the locking screw 58 is loosened, it can be displaced relative to the slot 60 thereby rotating cam 48 about its longitudinal axis. Rotation of the cam in turn displaces connecting rod 50, thereby displacing the collet sleeve 20 minutely clockwise or counter clockwise as shown in FIG. 2. Once the collet sleeve 20 has been appropriately adjusted in the radial direction, the radial adjusting cam locking screw 58 is tightened to lock the cam 48 relative to the head 18 and thus fix the collet sleeve 20 in position.

In the illustrated embodiment, the collet supporting head 18 is mounted for radial transverse movement relative to a head support 62, which like the head is preferably formed in two halves 64 that are coupled together. Radial movement of the cutter and radial transverse movement of the cutter together ensure that the surface of the cutter to be sharpened will be disposed parallel to the grinding tool.

In the illustrated embodiment, the bottom surface of the head 18 includes an arcuately extending T-shaped groove 66 for controlling transverse movement relative to the head support which in turn includes a T-shaped projection 68. The bottom surface of the head 18 is further provided with gear teeth as at 70 (not shown in detail) either formed integrally therewith or in the form of an attachment secured thereto. Adjustment of the head relative to the head support is effected via a rack and pinion gear.

The pinion gear, or radial transverse adjusting screw 72, is pivotally mounted to the head support 62. In accordance with the most preferred embodiment the adjusting screw 72 is mounted so as to be resiliently urged into nominal engagement with the gear teeth of the head. As can be seen, the adjusting screw 72 has teeth or threads 74 so that when the adjusting screw 72 is rotated, the head 18 will be minutely adjusted in the radial transverse direction relative to the head support 62. As noted above, the distal end 76 of the adjusting screw 72 is pivotally attached to the head support 62. The remainder 78 of the adjusting screw 72 is rotatable relative to the pivotally mounting end 76 in a known manner, for example via a ball and socket joint. Thus, the adjusting screw 72 can be displaced downwardly about pivot point 80, as shown by arrow A in FIG. 4, to disengage the pinion 72 from the gear teeth on the head 18. The head 18 may then be roughly adjusted in the radial transverse direction to approximate a horizontal disposition of the cutting face to be sharpened. The adjusting screw 72 then can then be returned to its generally horizontal disposition with the threads 74 thereof in engagement with the gear teeth. Rotation of the adjusting screw 72 then minutely adjusts the position of the head 18 relative to the head support 62. Once the head is suitably positioned, the head can be locked relative to the head support with a radial transverse locking knob 82, 82'. The knob may be of any desired configuration to facilitate its use as exemplified by the configurations shown in FIGS. 2 and FIG. 1A. As noted above, in the illustrated embodiment, both the head 18 and head support 62 are formed in two parts which are placed side by side to define the complete assembly, and coupled together. Thus, the radial transverse locking knob 82, 82' operates as a vice.

In the illustrated embodiment, the head support 62 is mounted to a palm base 84 which enables the user to firmly but comfortably grip the cutter sharpening accessory 10 and displace the accessory relative to the grinding tool 14 in a controlled manner. A smooth and ergonomically configured palm base is provided in the illustrated embodiment although it is to be understood that whether a palm base is provided and the shape thereof would depend largely upon the overall size of the cutter sharpening assembly, and consumer demand.

In accordance with the invention, furthermore, a mechanism is provided to permit incremental vertical height adjustment so that a series of sharpening passes can be made with the cutting face being gradually displaced relative to the grinding tool, to ensure appropriate sharpening. Although a variety of height adjusting mechanisms could be used and fully satisfy the needs of the present invention, an exemplary and currently most preferred mechanism is illustrated in FIGS. 1–4 and 20–22.

Figure 4:
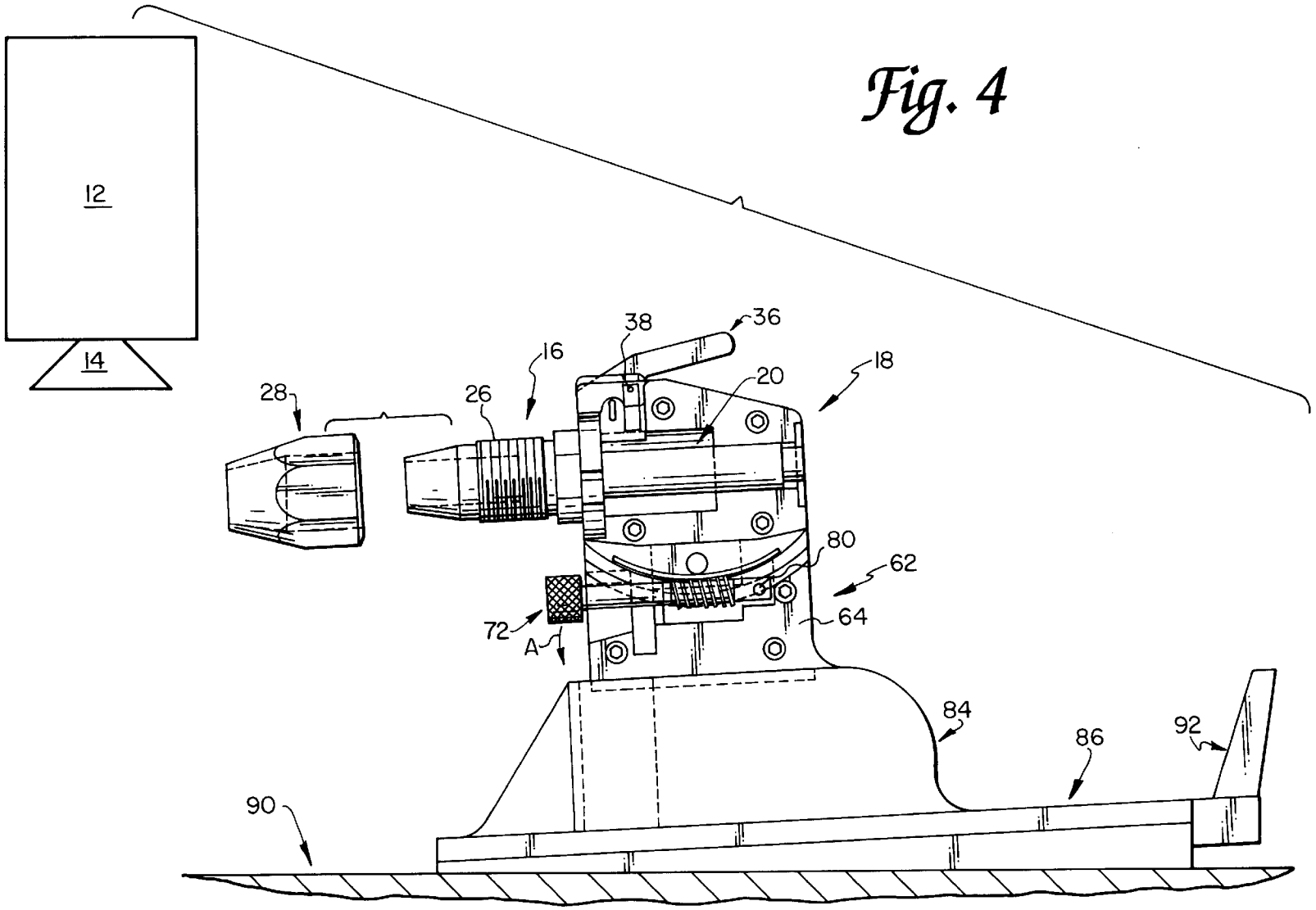
FIG. 4 is a schematic elevational view of the device of FIG. 2 with one half of the head support omitted to reveal, schematically the assembled head support provided in accordance with the invention.

In the illustrated embodiment, the vertical location adjustment mechanism is in the form of a generally wedge-shaped base 86 and a base plate 88 for sliding displacement relative to the base wedge 86. The base 86 and base plate 88 have a complementary configuration, such as the dove tail configuration shown. In use the base wedge 86 is disposed so that its bottom surface is disposed flush on a work surface 90 adjacent the drill press, radial arm saw or like device 12 to which the grinding tool 14 is secured. Minute adjustments in the height of the collet 16 and cutter mounted thereto can be accomplished by selectively rotating a vertical location adjusting knob 92. In the illustrated embodiment, the vertical location adjusting knob is suitably coupled to the base plate 88 and a threaded pocket therefor is defined in the base wedge 86. Rotation of a threaded rod (not shown) coupled to the adjusting knob relative to the base wedge, counterclockwise in the illustrated embodiment, displaces the base plate 88 to the right as shown in FIG. 4, thus incrementally raising the collet 16 and cutter mounted thereto. While as noted above a variety of height adjustment mechanisms could be provided in accordance with the invention, if the base plate and wedge assembly of FIGS. 1–4 and 20–22 is used, it is proposed that the vertical location adjusting knob 92 be a so called ratcheting knob which is spring loaded to be selectively ratcheted relative to the threaded rod so that the lever does not interfere with the work surface.

To prepare to sharpen a router bit or shaper, first the vertical location adjusting knob 92 is rotated until the base plate 86 is stacked directly above the base wedge 86. The collet 16 is then rotated so that the indexing locking lever 36 is locked into the zero locking slot and the radial adjusting cam 48 is adjusted so that the collet sleeve 20 is positioned at mid-travel. The cutter to be sharpened is, for example, inserted in to the collet and the collet nut 28 is slightly tightened. The cutter is then roughly positioned so that one cutter face is approximately parallel to the table or work surface. This is accomplished by turning the cutter in the collet 16 and rotating the head 18 in the head support 62. Once the cutter face is approximately parallel to the table surface, the collet nut 28 can be fully tightened.

The cutter is then positioned below the grinding tool 14 which in turn is mounted to the drill press, radial arm saw or the like 12. The radial adjusting cam locking screw 58 is then loosened and moved to micro position the cutter in the radial direction. Then, the radial transverse adjustment screw 72 is turned to micro adjust the cutter in the radial transverse direction. The pinion gear (radial transverse adjusting screw 72) can be disengaged from the rack to allow the head 18 to be moved rapidly without turning the radial transverse adjusting screw 72.

After the cutter is adjusted to its correct position radially transversely and radially, the radial transverse locking knob 82 and the radial adjusting cam locking screw 58 are tightened to lock the cutter in position. The table 90 and/or grinding cup wheel or like tool 14 are then adjusted until the cutter face just touches the grinding cup wheel. The grinding cup wheel drive mechanism, for example the drill press 12, is then turned on and the sharpening device 10 is slid back and forth several times under the grinding wheel to grind the face of the cutter. The radial indexing locking lever 36 is then depressed so that the collet 16 and cutter secured thereto can be rotated to the next position.

In the illustrated embodiment, the collet has a collet collar 22 with notches 44 machined at 90° and 120° increments to allow for use with cutters having two, three or four cutting faces. These notches 44 are used to rapidly and accurately index the cutter to the next desired radial location. Once the cutter has been indexed to the next desired radial location, the sharpening device is again slid back and forth several times under the grinding cup wheel 14. The remaining cutter faces are sequentially indexed to be ground sharpened by the back and forth linear movement of the device.

Once all cutter faces have been initially ground, the vertical location adjustment knob 92 is rotated, for example, ½ to 1 complete turn counterclockwise and each cutter face is again sharpened. In an exemplary embodiment, one complete turn of the vertical location adjusting knob 92 moves the cutter holder vertically approximately 0.002 inches. The vertical adjustment and sharpening steps are repeated until the cutter is fully sharpened.

While the invention has been described in connection with what is presently considered to be the most practical and preferred embodiment, it is to be understood that the invention is not to be limited to the disclosed embodiment, but on the contrary is intended to cover various modifications and equivalent arrangements included within the spirit and scope of the appended claims.

What is claimed is:

1. A method of sharpening cutting faces of a cutting tool comprising:

A) providing a cutter holder including:

a base support;

a head component coupled to the base support, said head component having a longitudinal axis, the head component being selectively displaceable relative to the base support, about an axis transverse to said longitudinal axis, whereby an inclination of the longitudinal axis of the head component relative to horizontal can be selectively varied; and a holder for securely receiving a cutter to be sharpened, said holder having a longitudinal axis, said holder being mounted to said head component so that said holder can be selectively rotated about its longitudinal axis, said holder being selectively angularly indexable relative to said head component;

securing a cutter tool to the cutter holder;

B) providing a mechanism for rotating a grinding tool with a grinding face thereof facing downwardly and in a horizontal plane;

C) providing a horizontal work surface under the grinding tool;

D) place the cutting tool to be sharpened in said holder;

E) rotate cutting tool in holder so that a cutting face thereof is generally parallel to the work surface;

F) displacing the head component about said transverse axis, relative to the base support, so that said cutting face is parallel to the work surface;

G) actuate the rotating mechanism so that the grinding tool rotates; and

H) slide the cutter holder back and forth under the grinding face so that the grinding face grinds said cutting face of the cutting tool.

2. A method as in claim 1, wherein said step of providing a cutter holder comprises providing a cutter holder having a mechanism for selectively minutely angularly adjusting the holder relative to the head component and wherein the method further comprises, after step E), the step of minutely angularly adjusting the holder relative to the head component.

3. A device for holding a cutter for grinding, comprising:

a base support;

a head component coupled to the base support, said head component having a longitudinal axis, the head component being coupled to said base support so as to be selectively displaceable relative to the base support, about an axis transverse to said longitudinal axis, whereby an inclination of the longitudinal axis of the head component relative to horizontal can be selectively varied;

a holder for securely receiving a cutter to be sharpened, said holder having a longitudinal axis, said holder being mounted to said head component so that said holder can be selectively rotated about its longitudinal axis, said holder including indexing structure whereby said holder is selectively angularly indexable relative to said head component; and further comprising a mechanism operatively engaged with said holder for continuously angularly adjusting the holder relative to the head component.

4. A device as in claim 3, further comprising a height adjustment mechanism for adjusting a height of said base support relative to a work surface on which said device is disposed.

5. A device as in claim 3, comprising:

a rack and pinion mechanism for selectively displacing said head component relative to said base component, said rack and pinion mechanism including a rack provided on a lower surface of the head component and a pinion mechanism selectively operatively engaged with said rack.

6. A device as in claim 5, wherein the pinion of the rack and pinion mechanism comprises an adjustment screw for selectively engaging said rack of said head component, rotation of said screw displacing said head component about said transverse axis, relative to said base support.

7. A device as in claim 6, wherein said screw is selectively pivotally displaceable out of engagement with said rack mechanism whereby gross displacement of said head component relative to said base support is possible.

8. A device as in claim 3, further comprising a clamping lock for selectively locking said head component to said base support at a selected angle of inclination.

9. A device for holding a cutter for grinding, comprising:

a base support;

a head component coupled to the base support, said head component having a longitudinal axis, the head component being coupled to said base support so as to be selectively displaceable relative to the base support, about an axis transverse to said longitudinal axis, whereby an inclination of the longitudinal axis of the head component relative to horizontal can be selectively varied;

a holder for securely receiving a cutter to be sharpened, said holder having a longitudinal axis, said holder being mounted to said head component so that said holder can be selectively rotated about its longitudinal axis, said holder including indexing structure whereby said holder is selectively angularly indexable relative to said head component; and further comprising a mechanism operatively engaged with said holder for minutely angularly adjusting the holder relative to the head component, wherein said mechanism for minutely angularly adjusting includes a cam element, rotation of said cam element minutely angularly adjusting the holder relative to the head component.

10. A device as in claim 9, further comprising a cam lock structure for selectively locking said cam to the head component.

* * * * *